United States Patent [19]

Ernst

[11] 3,946,919

[45] Mar. 30, 1976

[54] BINDING STRIP FEED TERMINATOR

[75] Inventor: Richard J. Ernst, Elk Grove Village, Ill.

[73] Assignee: Xerox Corporation, Stamford, Conn.

[22] Filed: Sept. 26, 1974

[21] Appl. No.: 509,579

[52] U.S. Cl. ..... 226/11; 226/34; 226/96; 226/155

[51] Int. Cl.[2] ..... B65H 17/22

[58] Field of Search ..... 226/2, 11, 34, 35, 38, 226/52, 55, 59, 154, 155, 96

[56] References Cited

UNITED STATES PATENTS

| | | | |
|---|---|---|---|
| 2,350,281 | 5/1944 | Krueger | 226/154 |
| 3,409,196 | 11/1968 | Brown | 226/11 |
| 3,675,877 | 7/1972 | Rempala | 226/11 |

*Primary Examiner*—Richard A. Schacher

[57] ABSTRACT

Apparatus for providing metered lengths of adhesive bearing strips, from a supply roll, to a mechanism for fixing each of the metered strips to a different one of a plurality of stacks of sheets comprises: a pair of rollers providing a nip, and means for rotating one of the rollers to advance adhesive strip engaged by the nip. The axial length of the nip is smaller than the width of the adhesive bearing strip and the strip includes a hole which is larger than the nip, the hole being located near the end of the roll. As a result, when the hole is advanced into the nip by the rollers the rollers stop feeding the adhesive bearing strip to the mechanism.

2 Claims, 12 Drawing Figures

30
34
35
33

32
17
19
20
18
24
23
15
11
16
36
31
102
100
30
90
25
22
57
10

FIG. 9
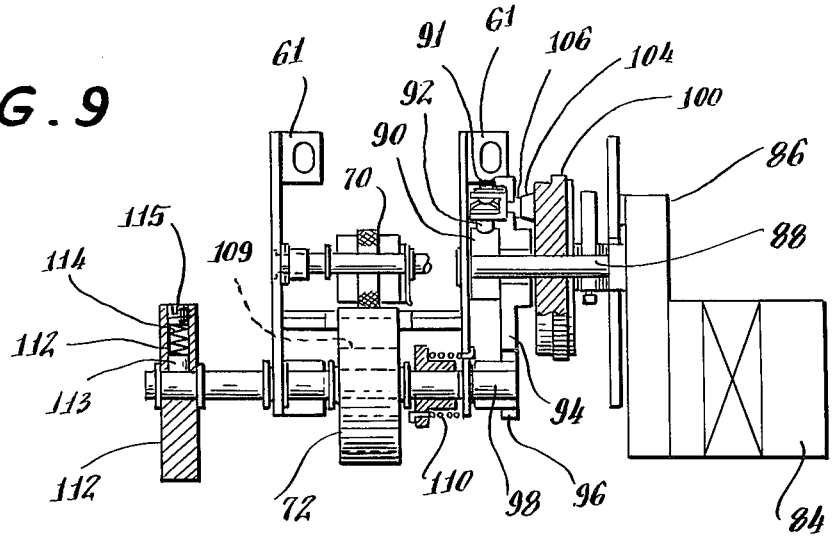
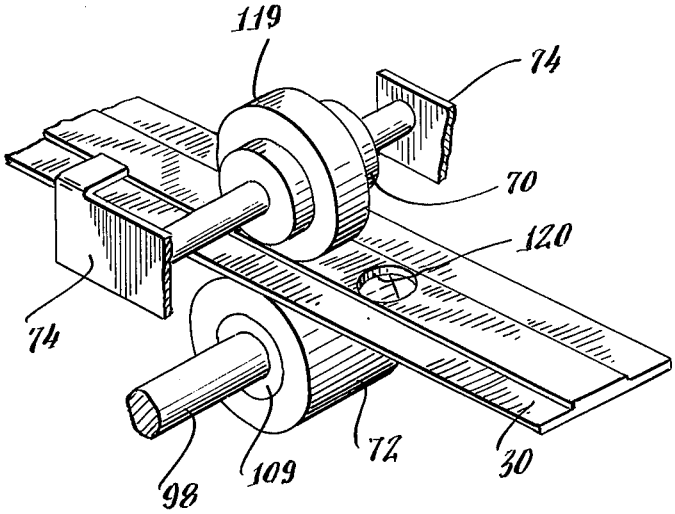
FIG. 10
FIG. 11A
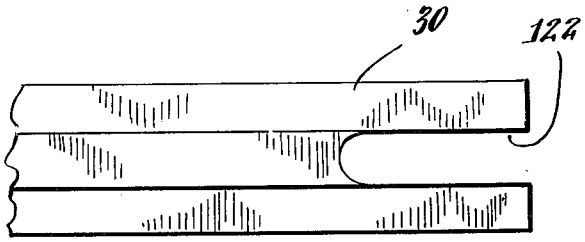
FIG. 11B
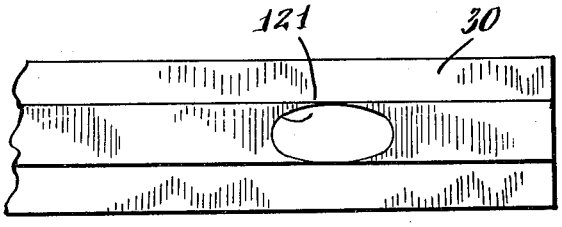

BINDING STRIP FEED TERMINATOR

The subject invention generally relates to apparatus for automatically stopping the feeding of stock when, for example, the stock is about to run out. More particularly, the subject invention relates to apparatus which terminates the feeding of binding strip to a bookbinding mechanism when a supply roll of binding strip is about to run out.

Mechanisms for detecting when a supply of stock or the like is about to run out are well known. For example, it is common to provide on driven stock indicia or a member, to provide a signal when the indicia or the member is detected, and to provide means which respond to the signal to turn the stock drive off. In practice, these systems include a plurality of parts which affect the overall cost of the system and its reliability.

Accordingly, it is an object of the present invention to provide a reliable and inexpensive apparatus for terminating the feeding of binding strip to a bookbinding mechanism when a supply roll of binding strip is about to run out.

It is another object of the present invention to provide apparatus for terminating the feeding of binding strip to a bookbinding mechanism without disturbing the means used to drive the binding strip to the mechanism.

It is still another object of the present invention to provide apparatus for terminating the feeding of a binding strip, having a non-uniform thickness, to a bookbinding mechanism.

Briefly, the invention herein sets forth apparatus for providing metered lengths of adhesive bearing strips, from a supply roll of adhesive bearing strips, to a mechanism for fixing each of the metered lengths to a different one of a plurality of stacks of sheets. The apparatus includes: (a) a first roller rotatably coupled to the mechanism; (b) a second roller rotatably coupled to the mechanism, said first and second rollers being located to provide a nip for engaging the adhesive bearing strip, the axial length of the nip being smaller than the width of the adhesive bearing strip; (c) drive means for rotating one of the rollers, whereby adhesive bearing strip engaged by the nip is fed to the mechanism; and (d) a hole, larger than the nip, aligned on the adhesive bearing strip for preventing advancement of the strip by the rollers when a predetermined length of adhesive bearing strip remains on said supply roll.

Additional objects and features of the invention will become apparent by reference to the following description in conjunction with the accompanying drawings, in which.

Figures 1, 2:
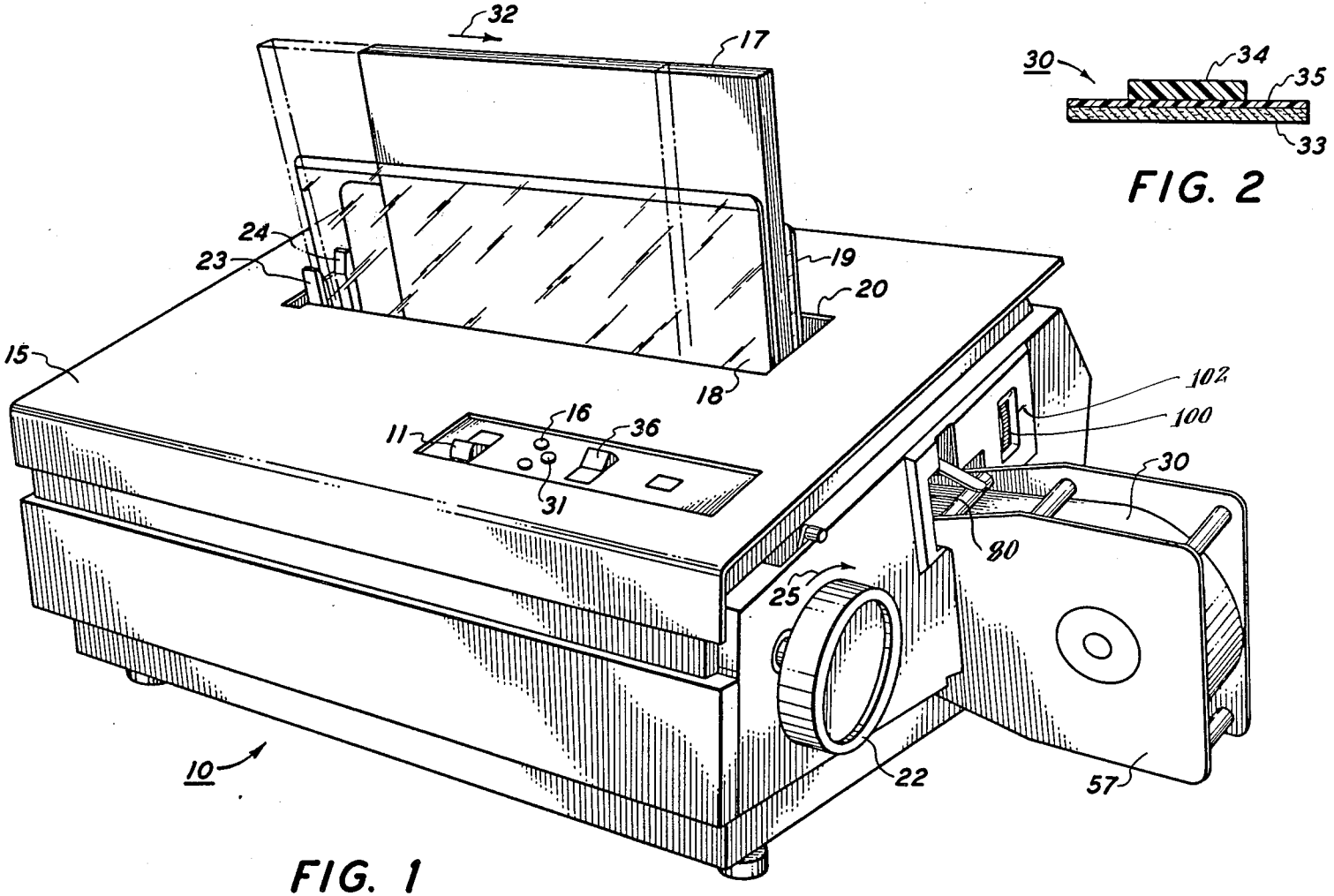
FIG. 1 is a perspective view of a bookbinding machine which embodies the subject invention.
FIG. 2 shows a cross-sectional view of an adhesive strip, according to the invention, which is used by the machine to bind a stack of paper sheets.
Figure 8:
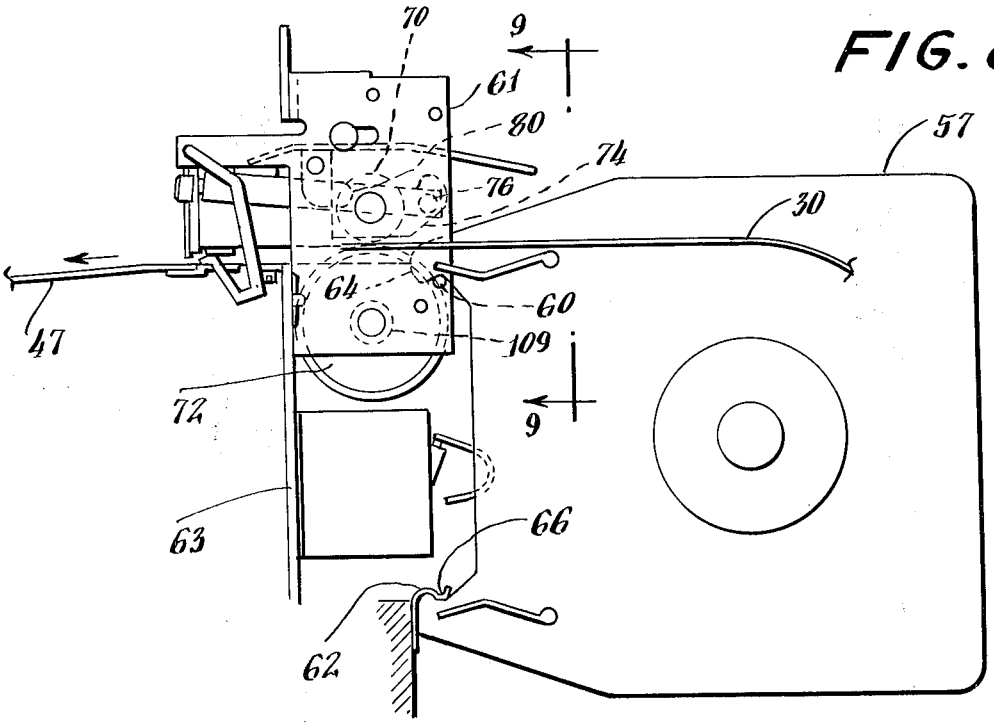

FIGS. 3–7 diagramatically show parts of the machine and their general movement during a binding cycle of the machine;

FIG. 8 is a side elevational view of the cartridge shown in FIG. 1 together with a side elevational view of apparatus for providing from a roll contained in the cartridge a metered length of adhesive strip;

FIG. 9 is a side plan view of the apparatus taken along lines 9—9 in FIG. 8, portions thereof having been broken away to facilitate disclosure of the apparatus;

FIG. 10 is a perspective view of rollers of the apparatus engaged with an end section of the adhesive strip, said strip having, according to the invention, a hole for preventing the feeding thereof by the rollers; and FIGS. 11*a* and 11*b* are top plan views of alternate embodiments of the adhesive strip.

FIG. 1 shows a perspective view of a bookbinding machine 10 which embodies the subject invention. Machine 10 is capable of applying an adhesive bearing substrate of suitable length and width to an edge of a stack of paper sheets, thereby making a book. A functional description of how machine 10 operates is set forth below, a more detailed description thereof having been disclosed in U.S. Pat. application Ser. Nos. 474,840 and 474,839, filed May 30, 1974 by R. J. Kuhns, and U.S. Pat. application Ser. Nos. 474,510 and 474,841 filed May 30, 1974 by E. Sarring.

Figure 3:
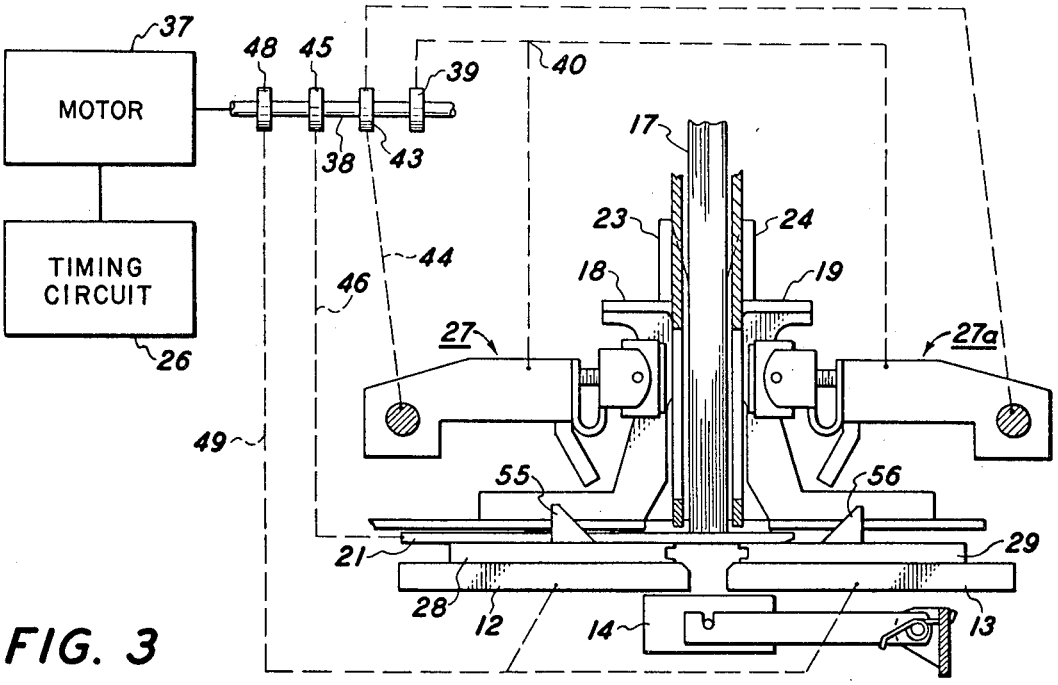
Figure 4:
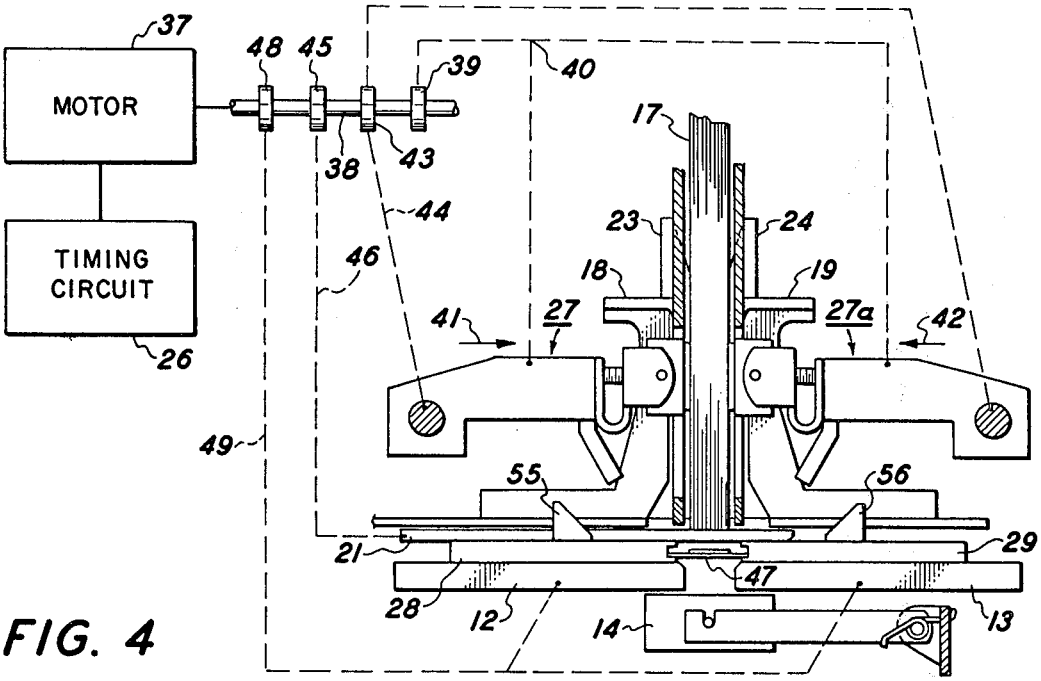

Referring to FIGS. 1 and 3, in the operation of machine 10 once a power switch 11 is actuated platens 12–14 within the housing 15 of the machine are heated with heating coils (not shown). Monitoring means (not shown) measure the temperature of the platens and when they reach a predetermined temperature an indicator light 16 turns on, thereby indicating that the machine is ready to perform a bookbinding cycle. To make a book a stack of paper sheets 17 to be bound is initially placed between page guides 18 and 19 at the extreme left end of the elongated slot 20 in the housing 15 (see dotted lines in FIG. 1). In this position, the pages rest on a movable plate 21 within the housing. The knob 22 is coupled to the page guides by a slip clutch and linkage such that rotation of the knob in the direction of the arrow 25 causes the page guides 18 and 19 to be moved toward each other until a pair of caliper members 23 and 24 mounted on page guides 18 and 19, respectively, abut and compress the stack of paper sheets 17. Thereafter, because of the resistance offered by the compressed stack of paper sheets and the use of a slip clutch, further rotation of the knob in the direction of arrow 25 has no effect on the spacing between the page guides 18 and 19 and the caliper members 23 and 24. Simultaneously with the movement of the page guides 18 and 19 and the caliper members 23 and 24 toward each other, rotation of the knob 22 in the direction of arrow 25 brings the heated platens 12 and 13 (see FIG. 3) toward each other and, therefore, the space between the platens 12 and 13 is determined by the thickness of the compressed stack of paper sheets. The latter is significant because such a setting of the distance between platens 12 and 13 permit their use in the binding of stacks of different thicknesses with only a slight additional movement of the platens during a subsequent part of the binding process. A linear clutch arrangement, shown in the referred applications, holds the page guides 18 and 19 and platens 12 and 13 in the position described while rotation of the knob 22 in the opposite direction moves bipartite means 27 and 27*a*, for clamping the stack of paper sheets 17, into position for clamping and moves strip guides 28 and 29 into a position (see FIG. 3) for receiving a suitable length of an adhesive bearing strip 30.

After calipering, as described above, the stack of paper sheets 17 are moved, as indicated by arrow 32 in FIG. 1, to the extreme right of elongated slot 20 and actuate sensing means (not shown) which turn an indicator light 31 on if a cartridge 57 having an adhesive strip, of suitable width, for binding is operatively engaged with machine 10.

As disclosed by the cross-sectional view of strip 30 (FIG. 2), the adhesive bearing strip 30 comprises a formable substrate 33 of, typically, relatively heavy paper stock, and adhesive coatings 34 and 35. Adhesive coatings 34 and 35 constitute a plurality of strip-like formations comprising two heat activated adhesive types. Heat activated adhesives may be either of the low or high tack types. A low tack adhesive comprises an adhesive material which when heated becomes fairly molten or fluid, thereby providing a high degree of surface wet-out with a minimum application of pressure or heat. A typical low tack adhesive may be a mixture of about 80% by weight of an ethylene/vinyl acetate copolymer having a 90% ratio of ethylene to vinyl acetate and about 20% by weight of rosin acid ester. A high tack adhesive comprises an adhesive material which when heated remains highly viscous and somewhat immobile so that a definite amount of heat is necessary to wet-out a surface being adhered. A typical high tack adhesive may be a mixture of polyethylene, a rosin acid, and a metal salt of a carboxylic acid, present in weight proportions of 80/10/10, respectively. High tack adhesive have the advantage that, on application of heat and pressure, the bond created thereby immediately possesses a high degree of strength. On the other hand, the low tack adhesives have the advantage that on application of heat and pressure the adhesive flows readily or is wicked into the edges of the paper sheets to be bound. The strip 30 preferably has the high tack adhesive 35 uniformly applied to the substrate 33 while the low tack adhesive 34 is applied along the center line of the substrate with a relatively greater thickness than that of the high tack material. Typically, the width of the adhesive 34 is approximately equal to or slightly greater than the overall compressed thickness of the stack of sheets to be bound. For a more detailed description of the strip reference may be had to a U.S. Pat. application Ser. No. 196,446, filed Nov. 1, 1971 by Donald W. Watson.

Figure 5:
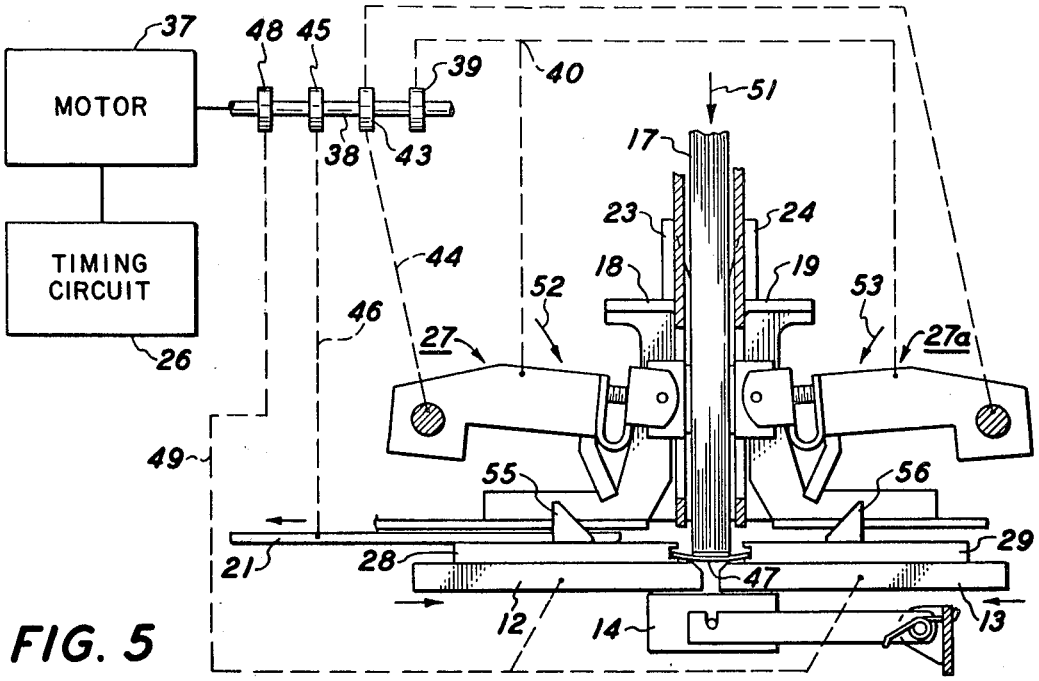
Figure 6:
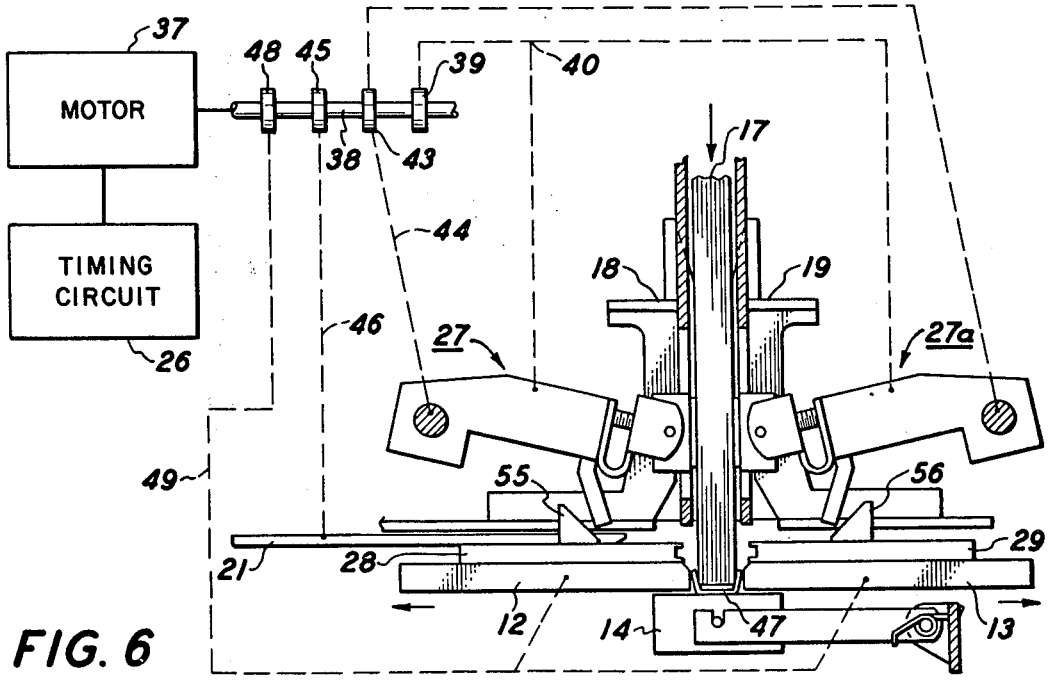
Figure 7:
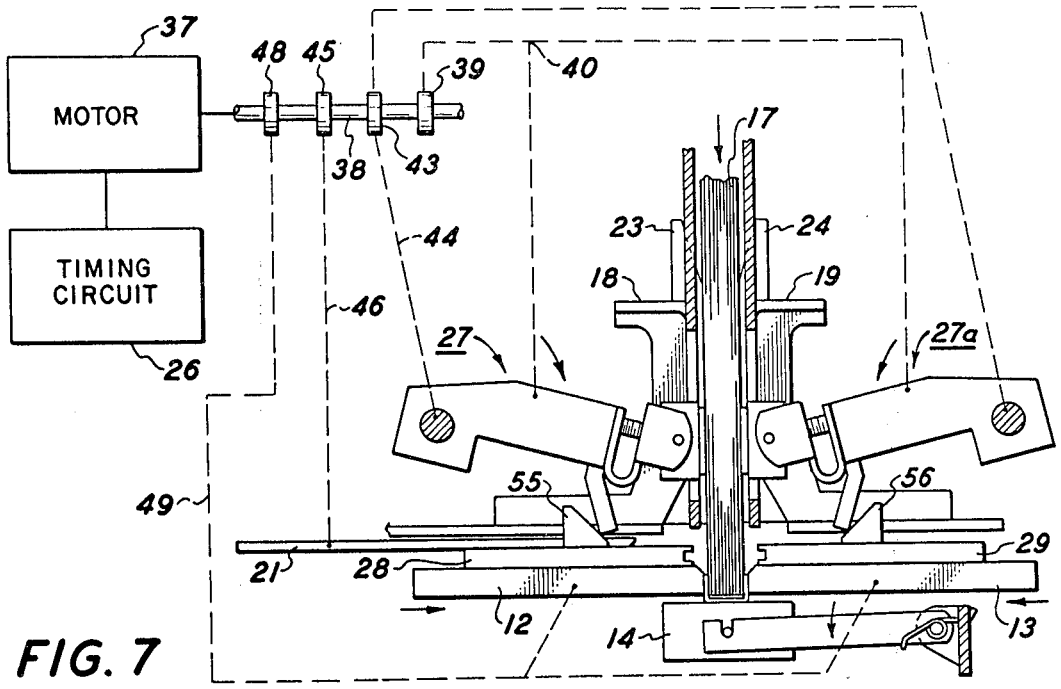

Referring again to FIG. 1, with suitable adhesive strip in the cartridge, actuation of a "blind button" 36 initiates an automatic binding cycle. More specifically, when button 36 is pressed a main drive motor 37 (see FIG. 3) is energized and rotates a main drive shaft 38 of the apparatus. A cam 39 carried by the main drive shaft effects movement of suitable linkage 40 resulting in movement of the clamping means 27 and 27a as indicated by arrows 41 and 42 in FIG. 4 and clamping of the stack of paper sheets 17. To this end, the page guides 18 and 19 are provided with suitable openings through which part of the clamping means move. After clamping, the main drive motor 37 is automatically de-energized by a timing circuit 26 for a predetermined period of time and a motor of a strip inserter, more fully described below, is actuated to insert a measured section 47 of strip 30 into the channel-shaped guides 28 and 29. Upon re-energization of the motor 37 a cam 43 carried by shaft 38 drives linkage 44, thereby rotating the clamping means and lifting the stack of paper sheets 17 from the movable plate 21 enough so that the plate 21 can be retracted from its page holding position by a cam 45 carried by the shaft 38 and connected by linkage 46 to the plate. Thereafter, the stack of paper sheets 17 can be plunged or moved in the direction of the heated platens 12–14. Referring to FIG. 5, simultaneously with the retraction of the plate 21 (see arrow 50), the lifting of the stack of paper sheets 17, and subsequent movement, as indicated by arrows 51–53, of the sheets downward, the platens 12 and 13 are moved toward each other by a cam 48 on shaft 38 and linkage 49 (see arrows 54 and 58). The cams 39 and 48 are designed to bring the stack of paper sheets into abutment with the strip section 47 and to move strip section 47 against the heated platens 12 and 13. Strip section 47 remains in contact with the top surfaces of the heated platens 12 and 13 for a period of time sufficient to effect preheating and softening thereof. After strip section 47 has been heated, the cams 43 and 48 effect a slight lifting of the stack of paper sheets and a separation of platens 12 and 13 sufficient to snugly accommodate the thickness of the compressed stack of sheets and the strip section. The stack of paper sheets 17 are then moved downwardly (see FIG. 6) and press strip section 47 into contact with heated and resiliently mounted bottom platen 14. Thereafter, platens 12 and 13 are biased against the strip section for a period of time sufficient to soften the high tack adhesive, thereby fixing the strip section to the sides of the stack of sheets. After the high tack adhesive has been softened the platens 12 and 13 are partially opened and "Cooking" of the low tack adhesive continues for a predetermined period of time. During this period the main motor is stopped by the timing circuit 26. Subsequently, the main motor is again energized and platens 12 and 13 are fully opened by cam 48 and linkage 49. Sequentially, the resulting book is then lifted to a position slightly above plate 21, plate 21 is returned to its book supporting position, and the resulting book is moved downwardly until it rests on the plate. Thereafter, the clamping means 27 and **27*a* are retracted from engagement with the book and the main motor is de-energized. The bound book can now be removed from the binding apparatus. It should be noted that in this plunge of the stack of paper sheets the clamping means are brought against abutment means 55 and 56 mounted on strip guides 28 and 29, respectively. Further, abutment means 55 and 56 are sloped to limit the plunge in proportion to the thickness of the stack of paper sheets. With this arrangement platens 12 and 13** always fix edge sections of the strip section against the sides of the stack of paper sheets and, consequently, a single width of strip section can be used to bind a stack of paper sheets within a predetermined thickness range.

The strip inserter advances a predetermined length of adhesive bearing strip from the cartridge 57 into the channel-shaped guides 28 and 29 and cutting means, such as disclosed in U.S. Pat. application Ser. No. 392,583 by R. J. Kuhns cut and complete the insertion of the length of strip 47 into the guides. Structurally, as disclosed in FIG. 8, the cartridge 57 containing the adhesive bearing strip 30 is removably mounted to the housing 15 by means of a rod 60 fixed by a bracket 61 to a frame plate 63 and a spring clip 62 attached to the housing 15. To this end, the rod 60 and spring clip 62 cooperate with pairs of lip portions 64 and 66 of the cartridge. As can be seen from a consideration of FIG. 8, the cartridge 57 is mounted so that its upper portion is aligned with the nip 68 formed by an upper feed roller 70 and a lower feed roller 72 of the strip inserter. With this arrangement, the leading edge of the adhesive bearing strip 30 can be conveniently threaded into the nip 68 and permits optimum feeding of the adhesive bearing strip from the cartridge to the guides 28 and 29.

To facilitate the threading of the adhesive bearing strip the upper feed roller 70 is mounted such that it can be temporarily moved out of engagement with the lower feed roller 72. To this end, the upper feed roller is rotatably carried by the central part of a U-shaped support member 74 and the support member is pivotably secured at its ends to a pin member 76 carried by bracket 61. A lever arm 80 extending outwardly from the housing 15 through an opening 82 (shonw in FIG. 1) includes a finger engagable with support member 74 and serves to lift the upper roller 70 out of its engagement with the lower roller 72 through movement of the lever in an upward direction, suitable biasing means, such as a spring (not shown), being provided for returning the upper feed roller to its nip forming position with the lower feed roller.

In FIG. 9 there is disclosed additional parts of the strip inserter, among which are a strip feed motor 84 and a gear box 86, the latter of which houses suitable gears for providing speed reduction and control of an output shaft 88 from the gear box 86. A driving lever 90 is carried approximate the end of the shaft 88 such that it can engage a detent member 92 carried by a drive gear 94. The gear 94 serves to drive a driven gear 96 supported by shaft 98 and shaft 98 is coupled via a one-way clutch 109 to the lower feed roller 72. Therefore, when the output shaft 88 rotates and clutch 109 is engaged the lower feed roll 72 also rotates to thereby feed adhesive bearing strip.

It is desired to reliably feed or meter different lengths of adhesive bearing strip depending on the length of an edge on a stack of sheets which is to be bound into a book. Accordingly, adjustable feed is accomplished by the provision of a metering mechanism including a metering wheel in the form of a thumb actuatable wheel 100 which protrudes through one side wall of the housing 15 (FIG. 1) to permit setting thereof in accordance with indicia (not shown) on its periphery which is aligned with an index mark 102 on the aforementioned side wall.

The metering wheel carries a stop member 104 on one face (i.e., to the left as viewed in FIG. 9) which stop serves as a fixed abutment engagable by a sidewardly projecting pin member 106 carried by the drive gear 94. For this purpose, means, such as a pawl fixed to bracket 61 and engagable ratchet teeth on the wheel (not shown), are provided to prevent the metering wheel from rotating in the counterclockwise direction, as viewed from the right in FIG. 9, once the wheel has been manually set in accordance with the desired length of adhesive strip to be metered. In operation, when motor 84 is actuated lever 90 engages and rotates the detent member away from an abutment 91, thereby rotating gear 94 until stop member 104 engages pin 106. Engagement of the stop member 104 by the sidewardly projecting pin member will cause the driving lever 90 to move the detent member against the bias of a bellville washer 108 which allows the driving lever to move past the detent to thereby effect disconnection of the driving coupling therebetween to terminate rotation of the lower feed roller 72, which, as will be appreciated, terminates the feed of adhesive bearing strip.

During feeding of the adhesive bearing strip, a spring member 110, secured at one end to the shaft and at its other end to bracket 61, is tensioned through clockwise rotation, as viewed from the right in FIG. 9, of the shaft 98. Once the feeding has stopped and the strip material has been cut the spring functions to reposition the sidewardly extending pin member 106 to its "start-of-feed position" through rotation of the gears 90 and 94. During repositioning clutch 109 is disengaged from roller 72 and roller 72 is not driven. It will be appreciated that the relative angular distance between the pin member 106 and the stop member 104 determines the length of strip material that is fed during one cycle of operation. It will also be appreciated that the length of the strip material fed can be varied by changing the aforementioned arc angular distance length which, in this embodiment, is accomplished by setting of the metering wheel.

Shaft 98 rotatably carries a disc-like flywheel 111 which includes a radial bore 112 having a threaded peripheral end section. In the bore there is slidably located a Delrin plug 113, a spring 114, and a set screw 115 engaged with the threaded end section to press the spring against the plug. Plug 113 abuts shaft 98 and the frictional force therebetween is determined by the depth to which the set screw 115 is inserted. Thus, a spring loaded Delrin plug permits the flywheel to turn on shaft 98 with an adjustable degree of slip. As previously mentioned, during the process of feeding spring member 110 is tensioned and this tension drives gears 96 and 94. However, during this process energy stored in the spring member is partially absorbed by the starting inertia of the flywheel 111 and when detent member 92 moves against abutment 91 the rotational inertia of the flywheel causes the flywheel to overtravel. The over-travel provides a torque which prevents rebounding of the detent member. Since clutch 109 would cause adhesive strip to be advanced if the detent member bounced and rotated gear 94, it may be seen that the flywheel eliminates unmetered feeding of the adhesive bearing strip. Although Delrin has been selected in this embodiment because of its properties, e.g., eliminates any need to lubricate the shaft and is insensitive to humidity, it should be noted that other materials may be used to provide a frictional engagement with the shaft 98. Moreover, it should be noted that the frictional force between the plug and the shaft may be varied to optimally damp the return of the detent member and, consequently, roller 72, when the automatic strip feeding apparatus is assembled and when plug 113 wears down.

Since adhesive strip 30 has a finite length and books having various lengths are bound by machine 10, when the end of adhesive strip 30 is reached some means must be provided to prevent the feeding of a strip which is not long enough to be useful for binding. To this end, rollers 72 and 70 are adapted such that the nip therebetween has an axial length which is shorter than the width of the adhesive strip 30 and a hole 120 (see FIG. 10) larger than the nip area is provided in the center of and near the end of the strip. With this arrangement, as the adhesive strip is depleated and the hole 120 is fed into the machine, the strip will come to a stop when the hole is between the rollers. It should be noted that a section of the hole 120 which is larger than the nip area is spaced a predetermined distance from the trailing end of the adhesive strip and as a result, when the adhesive strip comes to a stop the end of the adhesive strip is available to an operator for removal. While the hole 120 in FIG. 10 is circular, it should be noted, as shown in FIGS. 11*a* and 11*b*, that the hole can have other shapes such as the slot 122 or the oval hole 121.

It is to be understood that the description herein of a preferred embodiment, according to the invention, is set forth as an example thereof and is not to be construed or interpreted as a limitation on the claims which follow and define the invention.

What is claimed is:

1. Apparatus for providing metered lengths of adhesive bearing strips, from a supply roll of adhesive bearing strip, to a mechanism for fixing each of the metered lengths to a different one of a plurality of stacks of sheets, comprising:

a. a first roller rotatably coupled to the mechanism;

b. a second roller rotatably coupled to the mechanism, said first and second rollers being located to provide a nip for engaging the adhesive bearing strip, the axial length of the nip being smaller than the width of the adhesive bearing strip;

c. drive means for rotating one of the rollers, whereby adhesive bearing strip engaged by the nip is fed to the mechanism; and, d. a hole, larger than the nip, aligned on the adhesive bearing strip for preventing advancement of the strip by the rollers when a predetermined length of adhesive bearing strip remains in said supply roll.

2. Apparatus as defined in claim 1 wherein said adhesive bearing strip comprises: a substrate, a layer of low tack adhesive fixed to and extending along the center of the substrate and a pair of layers of high tack adhesive fixed to the substrate and flanking the high tack adhesive.

* * * * *